US009515440B2

(12) United States Patent
Jarmuth

(10) Patent No.: US 9,515,440 B2
(45) Date of Patent: Dec. 6, 2016

(54) MULTIPORT TERMINAL WITH CURRENT BARS

(71) Applicant: Phoenix Contact GmbH & Co. KG, Blomberg (DE)

(72) Inventor: Volker Jarmuth, Horn-Bad Meinberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/654,426

(22) PCT Filed: Dec. 19, 2013

(86) PCT No.: PCT/EP2013/077456
§ 371 (c)(1),
(2) Date: Jun. 19, 2015

(87) PCT Pub. No.: WO2014/096233
PCT Pub. Date: Jun. 26, 2014

(65) Prior Publication Data

US 2015/0349476 A1 Dec. 3, 2015

(30) Foreign Application Priority Data

Dec. 20, 2012 (DE) ..... 10 2012 112 813

(51) Int. Cl.
*H01R 25/00* (2006.01)
*H01R 27/02* (2006.01)
(Continued)

(52) U.S. Cl.
CPC ..... *H01R 25/006* (2013.01); *H01R 9/2608* (2013.01); *H01R 4/4809* (2013.01); *H01R 43/16* (2013.01)

(58) Field of Classification Search
CPC ..... H01R 9/2608; H01R 4/4809; H01R 43/16; H01R 25/00
(Continued)

(56) References Cited

U.S. PATENT DOCUMENTS 7,785,134 B2 * 8/2010 Dhandapani ..... H01R 4/4818 439/441

FOREIGN PATENT DOCUMENTS

DE 28 02 686 7/1979
DE 30 10 736 9/1981
(Continued)

OTHER PUBLICATIONS

Machine Translation of DE 20 2009 013335. No Date.*
International Search Report received in PCT Application No. PCT/EP2013/077456, dated Mar. 14, 2014, in 4 pages.

*Primary Examiner* — Javaid Nasri
(74) *Attorney, Agent, or Firm* — Knobbe, Martens, Olson & Bear LLP

(57) ABSTRACT

The invention relates to a multiport chamber (1) with current bar (5) for receiving a plurality of cables to be connected to an electrical unit, wherein a plurality of electrically conductive connection chambers (4) are provided for a plurality of cables and the connection chambers (4) are connected to the current bar (5) in order to establish a further electrical connection in the electrical unit. In accordance with the invention the current bar (5) is configured in such a way that it forms a plurality of walls (6) of the connection chambers (4) and also a partition wall (7) between the connection chambers (4). A multiport chamber (1) that can be easily produced is thus provided.

10 Claims, 1 Drawing Sheet

(51) Int. Cl.

| | |
|---|---|
| ***H01R 31/00*** | (2006.01) |
| ***H01R 9/26*** | (2006.01) |
| *H01R 4/48* | (2006.01) |
| *H01R 43/16* | (2006.01) |

(58) Field of Classification Search
USPC ..... 439/638, 441
See application file for complete search history.

(56) References Cited

FOREIGN PATENT DOCUMENTS

| | | |
|---|---|---|
| DE | 202 15 294 | 12/2002 |
| DE | 203 13 855 | 2/2005 |
| DE | 20 2009 013 335 | 12/2010 |
| DE | 10 2011 115 637 | 12/2012 |
| EP | 0 472 040 | 2/1992 |
| EP | 2 204 885 | 7/2010 |
| WO | WO 2014/096233 | 6/2014 |

* cited by examiner

MULTIPORT TERMINAL WITH CURRENT BARS

CROSS-REFERENCE TO RELATED APPLICATION

The present application is the U.S. National Phase under 35 U.S.C. §371 of International PCT application number PCT/EP2013/077456, filed Dec. 19, 2013, which claims priority to German Application No. 10 2012 112 813.8, filed Dec. 20, 2012, the content of which is incorporated herein by reference in its entirety.

FIELD

The invention relates to a device for receiving electrical cables, in particular as component of a connection arrangement.

BACKGROUND

A problem that occurs in many cases in electrical installation technology is that of electrically connecting an electrical unit to individual connection cables.

Various connection arrangements, such as screw-type terminals or insulation displacement connectors, are known for this purpose from the prior art. Here, one task of the connection arrangement is to reliably contact a cable and to provide an electrical connection to an electrical unit.

The connection arrangement for this purpose often has connection chambers into which the cables are introduced for contacting. These connection chambers in many cases are electrically conductive, such that the electrical connection between a cable and the electrical unit can be established via the electrically conductive connection chamber and a conductor, or what is known as a current bar, electrically connected thereto.

For efficient installation, it is advantageous when a separate connection chamber is provided for each conductor to be connected. This is also the case when a number of conductors are to be connected to the same contact of the electrical unit.

If, for example, two separate connection chambers instead of one common connection chamber are provided for two conductors, it is possible to prevent a first introduced conductor from already filling out the common connection chamber in such a way that a reliable introduction of the second conductor is not ensured. For this reason, multiport chambers also advantageously have partition walls, such that a separate connection chamber is provided for each conductor to be connected.

The object of the invention is to specify a multiport chamber that can be easily produced.

The object is achieved in accordance with the invention by the features of the subject matter of claim 1. Advantageous embodiments of the invention are specified in the dependent claims.

SUMMARY

In accordance with the invention a multiport chamber with current bar for receiving a plurality of cables to be connected to an electrical unit is thus provided, wherein a plurality of electrically conductive connection chambers are provided for a plurality of cables and the connection chambers are connected to the current bar in order to further establish an electrical connection in the electrical unit, wherein the current bar is designed in such a way that it forms a plurality of walls of the connection chambers and also a partition wall between the connection chambers. A key aspect of the invention thus lies, inter alia, in forming the walls of the connection chambers, the partition wall and the current bar by a single component part, i.e. in one piece.

The solution according to the invention has a number of advantages. If the walls, partition wall and current bar are formed by a single component part, no transition resistance or contact problems can occur between these components. The risk of a mis-contacting or a development of heat on account of high transition resistances is thus reduced or eliminated in this respect.

Furthermore, the assembly of an individual component part is less complex than the assembly of a number of component parts. In addition, the handling and the provision of a number of components are more costly than for a single component part.

The current bar is advantageously also formed as a stamped and bent element. A current bar fabricated for example from sheet metal by means of stamping and bending technology can meet high demands on conductivity and also high demands on the contact properties. The current bar thus can be fabricated economically by means of available tool technology.

The current bar is advantageously formed flat in a portion W and is folded in this portion such that two walls of a connection chamber are formed. Such a formation is very easily attained by shaping a sheet metal by means of stamping and bending.

The current bar advantageously also has a portion T, which, in terms of its form, is suitable for forming a partition wall between the connection chambers. Here, it is also advantageously possible that this partition wall is formed by a folding of the current bar. In addition, the partition wall is advantageously formed by a rearward folding of the portion T of the current bar.

This embodiment allows a successive shaping of the current bar. In an advantageous embodiment the portions W and T of the current bar directly border one another or at least indirectly border on one another. If the current bar is fabricated for example from a sheet metal, an incision in the region of the transition from portion W to portion T, by the folding of a right angle along the transition region combined with a rearward folding of the portion T, thus allows a wall to be formed in the portion W, which wall can perform the function of a partition wall.

The current bar more advantageously has a contact portion K, in which it is formed as a contact in order to establish a further electrical connection in the electrical unit. A design of this type of a contact can be provided for example in the form of a spring contact or also by the forming of a contact tulip. An embodiment of this type of the conductor offers the advantage of being able to directly contact further conductors, such as a busbar.

The current bar also advantageously has a guide portion F, in which it forms a guide, such that a cable to be connected can be introduced into a corresponding connection chamber. This portion is advantageously folded in such a way that it forms a funnel or a sliding surface, such that a cable to be connected is passed into the connection chamber during the insertion process.

The current bar advantageously additionally has a portion R, in which it forms a further wall of the connection chamber. The portion R is advantageously provided between the portions W and T, such that the conductor for example may form four walls of a cuboidal connection chamber.

The multiport chamber according to the invention is advantageously suitable for the connection of a plurality of conductors to a terminal housing. The use of relatively thin sheet metals and the one-piece embodiment allow a compact embodiment of the multiport chamber according to the invention. Compared with an embodiment formed from a number of components, a one-piece embodiment requires fewer fastening points, such that a simple and compact construction is possible. A particular suitability therefore lies in the forming of the multiport chamber and also of the current bar of a narrow terminal housing.

The invention will be explained in greater detail hereinafter with reference to the drawing on the basis of preferred exemplary embodiments.

DETAILED DESCRIPTION

Figure 1:
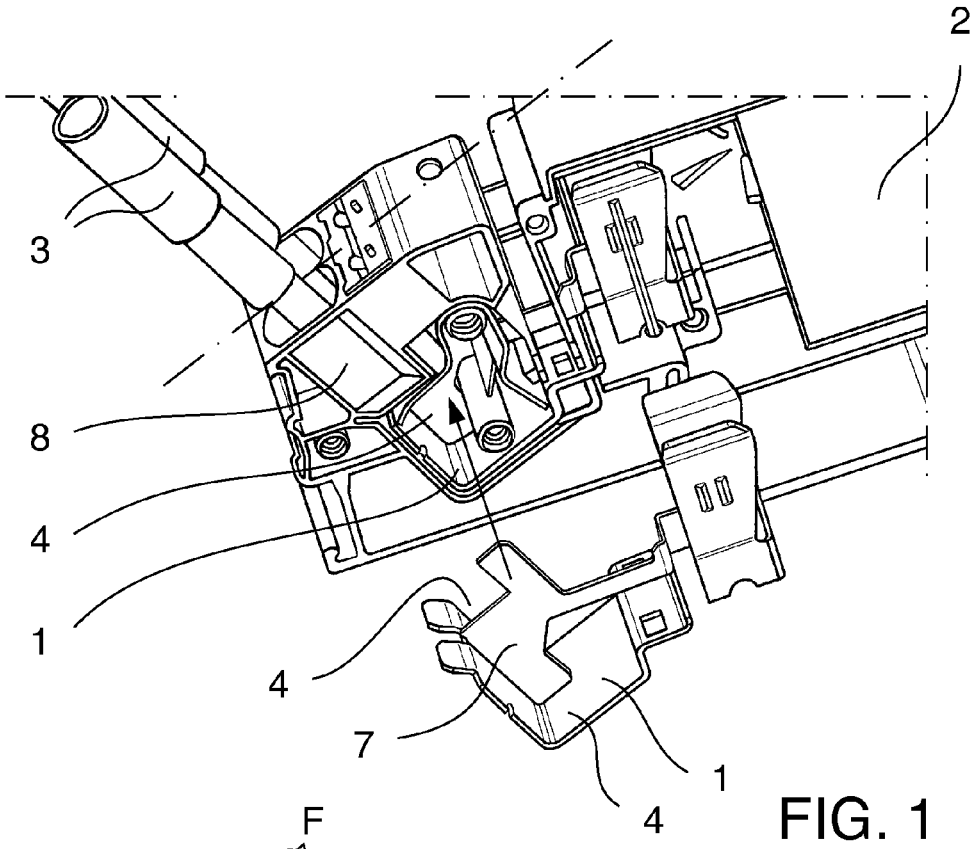
FIG. 1 shows a connection terminal with a multiport chamber in accordance with a preferred exemplary embodiment of the invention in a perspective illustration.

As can be seen from FIG. 1, the terminal housing 2 has a multiport chamber 1, into which the stripped ends of cables 3 can be introduced. The multiport chamber 1 has two connection chambers 4, which are separated from one another by a partition wall 7.

The device, which is embodied as a stamped and bent element, combines the components of a multiport chamber 1 with partition wall 7, the components of a contact terminal K for contacting a contact rail (not shown) located in the terminal housing and also the components of a current bar 5 connecting the multiport chamber 1 and the contact terminal K.

Figure 2:
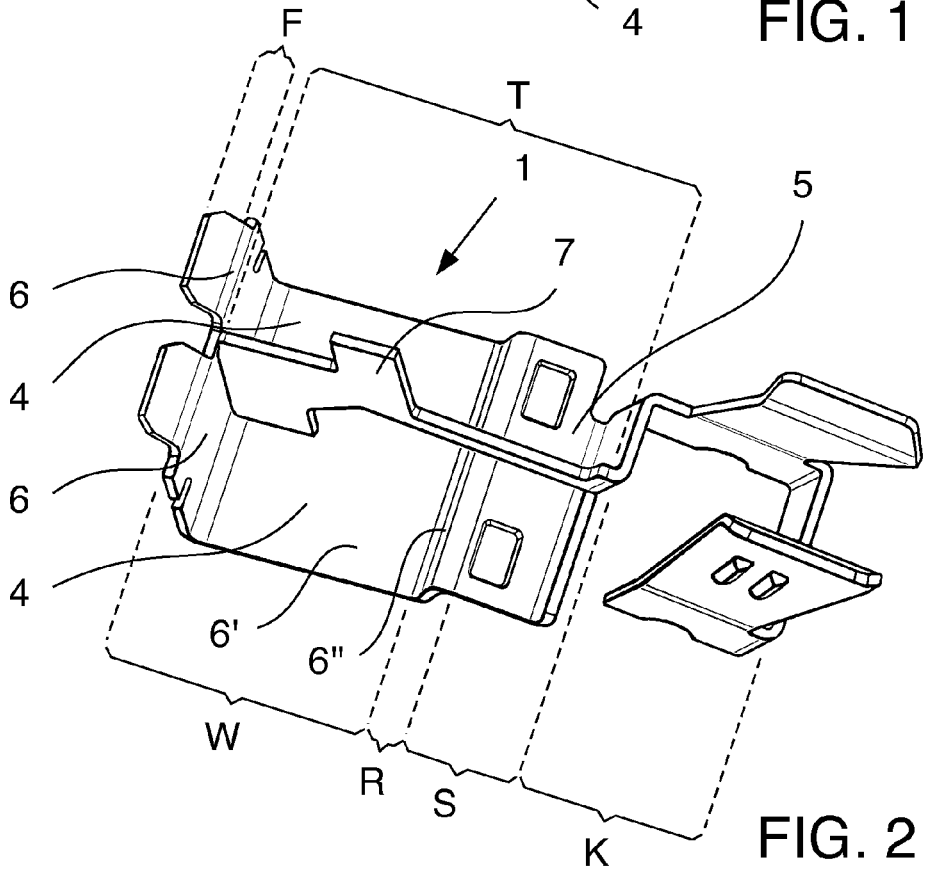
FIG. 2 shows a multiport chamber in accordance with a preferred exemplary embodiment of the invention, likewise in perspective illustration.

FIG. 2 shows a multiport chamber 1 formed from a stamped and bent element, said chamber having a partition wall 7 and also a contact region K, in which a contact tulip is formed from two legs of the stamped and bent element. In the region between the multiport chamber 1 and the contact region K, the stamped and bent element forms a current bar 5. The current bar 5 embodied as a stamped and bent element thus forms, at the ends thereof, a multiport chamber 1 and also a contact terminal.

In the embodiment shown in FIG. 2 the current bar 5 has the regions F, W, R, S, T and K, more specifically in this sequence. In the region W the current bar 5 is formed flat. By folding by an angle of approximately 90°, two faces 6 and 6' arranged substantially orthogonally relative to one another are formed and form two walls of the multiport chamber 1.

The region F of the current bar is provided in a manner bordering the region W. In this region F, two tabs are formed, which lie in a plane inclined by approximately 45° to the wall 6 and therefore form a funnel with respect to the connection chambers 4, at least in portions. The region R is likewise provided in a manner bordering the region R, which region R is folded in relation to the wall 6' by approximately 90° and therefore forms a further wall 6" of the connection chambers 4.

A region S borders the region W, in which region S the current bar 5 performs the function of an electrical connection between the multiport chamber 1 and the contact region K. In the transition from region S to region K the current bar 5 has an incision on one side. Here, a region T is provided on the side of the incision and is angled rearward by approximately 90° and thus forms a partition wall 7 within the multiport chamber 1.

Lastly, in the region K the ends of the current bar 5 are shaped in such a way that two legs are formed, which constitute a contact tulip.

LIST OF REFERENCE SIGNS multiport chamber 1
electrical unit 2
cable 3
connection chamber 4
current bar 5
wall 6
wall 6'
wall 6"
wall 7
terminal housing 8

The invention claimed is:

1. A multiport chamber for receiving a plurality of conductive cables to be electrically connected to an electrical unit, the multiport chamber comprising:

a current bar having a portion thereof which forms a plurality of electrically conductive connection chambers for receiving the plurality of conductive cables for establishing a further electrical connection in the electrical unit, wherein the portion of the current bar forms a plurality of walls of the connection chambers and further forms a partition wall separating adjacent ones of the connection chambers, and wherein the current bar is a single piece article including the portion that forms the walls and the partition.

2. The multiport chamber according to claim 1, wherein the current bar is formed as the single piece article that is stamped and bent.

3. The multiport chamber according to claim 2, wherein the current bar is folded to form adjoining walls including a bottom flat portion extending in a first plane and a first vertical flat portion extending in a second plane crossing the first plane to define two walls of each connection chamber.

4. The multiport chamber according claim 3, wherein the current bar further comprises another portion which forms another partition wall separating the adjacent ones of the connection chambers.

5. The multiport chamber according to claim 4, wherein the another portion forms the partition wall by being folded such that a major surface of the another portion extends in a third plane crossing the first plane and the second plane.

6. The multiport chamber according to claim 4, wherein the current bar further comprises a contact portion serving as an electrical contact for establishing the further electrical connection in the electrical unit.

7. The multiport chamber according to claim 4, wherein the current bar further comprises a guide portion which forms a guide, by means of which a cable to be connected is guided during the introduction into one or more of the connection chambers.

8. The multiport chamber according to claim 4, wherein the current bar further comprises a second vertical portion facing the first vertical portion which forms a further wall of the connection chamber.

9. The multiport chamber according to claim 4, wherein the partition wall is formed by a rearward folding of the another portion of the current bar.

10. A terminal housing comprising the multiport chamber according to claim 1 for the connection of the plurality of conductors.

* * * * *